US008311468B2

(12) United States Patent
Qi et al.

(10) Patent No.: US 8,311,468 B2
(45) Date of Patent: Nov. 13, 2012

(54) INDUCTION HEATED MEMBER

(75) Inventors: Yu Qi, Oakville (CA); Qi Zhang, Milton (CA); Nan-Xing Hu, Oakville (CA); Gerald A. Domoto, Briarcliff Manor, NY (US); Nicholas P. Kladias, Flushing, NY (US)

(73) Assignee: Xerox Corporation, Norwalk, CT (US)

( * ) Notice: Subject to any disclaimer, the term of this patent is extended or adjusted under 35 U.S.C. 154(b) by 17 days.

(21) Appl. No.: 13/310,253

(22) Filed: Dec. 2, 2011

(65) Prior Publication Data

US 2012/0070208 A1 Mar. 22, 2012

Related U.S. Application Data

(62) Division of application No. 12/618,860, filed on Nov. 16, 2009, now Pat. No. 8,099,035.

(51) Int. Cl.
*G03G 15/20* (2006.01)
*H05B 6/14* (2006.01)

(52) U.S. Cl. ..... 399/328; 219/619

(58) Field of Classification Search ..... 399/328, 399/329; 219/619
See application file for complete search history.

(56) References Cited

U.S. PATENT DOCUMENTS

| | | | | |
|---|---|---|---|---|
| 4,257,699 | A | 3/1981 | Lentz | |
| 5,017,432 | A | 5/1991 | Eddy et al. | |
| 5,061,965 | A | 10/1991 | Ferguson et al. | |
| 5,166,031 | A | 11/1992 | Badesha et al. | |
| 5,281,056 | A | 1/1994 | Lawson et al. | |
| 5,366,772 | A | 11/1994 | Badesha et al. | |
| 5,370,931 | A | 12/1994 | Fratangelo et al. | |
| 5,501,881 | A | 3/1996 | Fuller et al. | |
| 5,512,409 | A | 4/1996 | Henry et al. | |
| 5,729,813 | A | 3/1998 | Eddy et al. | |
| 7,054,589 | B2 | 5/2006 | Okayasu et al. | |
| 7,060,349 | B2 | 6/2006 | Tamemasa et al. | |
| 7,112,472 | B2 | 9/2006 | Dubin | |
| 8,099,023 | B2 * | 1/2012 | Law | 399/176 |
| 2006/0285896 | A1 | 12/2006 | Beach et al. | |
| 2008/0131159 | A1 | 6/2008 | Sone et al. | |
| 2009/0087663 | A1 | 4/2009 | Park | |
| 2009/0162761 | A1 * | 6/2009 | Law et al. | 430/48 |
| 2010/0209154 | A1 | 8/2010 | Kim et al. | |

OTHER PUBLICATIONS

U.S. Appl. No. 12/618,860, filed Nov. 16, 2009, Office Action dated Jul. 15, 2011.

U.S. Appl. No. 12/618,860, filed Nov. 16, 2009, Office Action dated Mar. 23, 2011.

* cited by examiner

*Primary Examiner* — Joseph S Wong
(74) *Attorney, Agent, or Firm* — Hoffman Warnick LLC

(57) ABSTRACT

Exemplary embodiments provide an induction heating member including a substrate and a heating layer disposed on the substrate. The heating layer includes carbon nanotubes and metal. An outer layer is disposed on the heating layer and includes a fluoropolymer.

20 Claims, 4 Drawing Sheets

INDUCTION HEATED MEMBER

CROSS-REFERENCE TO RELATED APPLICATIONS

This application is a divisional of co-pending U.S. patent application Ser. No. 12/618,860.

TECHNICAL FIELD

The presently disclosed embodiments relate generally to layers that are useful in imaging apparatus members and components for use in electrophotographic, including digital, apparatuses. More particularly, the embodiments pertain to an inductively heated fuser member including a layer of carbon nanotubes and metal.

BACKGROUND

In electrophotography, also known as xerography or electrophotographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members. The visible toner image thus transferred on the print substrate, which is in a loose powdered form and can be easily disturbed or destroyed, is usually fixed or fused to form permanent images. The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Several approaches to thermal fusing of electroscopic toner images have been described in the prior art. These methods include providing the application of heat and pressure substantially concurrently by various means: a roll pair maintained in pressure contact, a belt member in pressure contact with a roll, and the like. Heat may be applied by heating one or both of the rolls, plate members or belt members. The fusing of the toner particles takes place when the proper combination of heat, pressure and contact time is provided. The balancing of these parameters to bring about the fusing of the toner particles is well known in the art, and they can be adjusted to suit particular machines or process conditions.

Fuser and fixing rolls or belts may be prepared by applying one or more layers to a suitable substrate. Typically, fuser and fixing rolls or belts include a surface layer for good toner releasing. Cylindrical fuser and fixer rolls, for example, may be prepared by applying a silicone elastomer or fluoroelastomer to serve as a releasing layer. The coated roll is heated to cure the elastomer. Such processing is disclosed, for example, in U.S. Pat. Nos. 5,501,881; 5,512,409; and 5,729,813. Known fuser surface coatings also include crosslinked fluoropolymers such as VITON-GF® (DuPont) used in conjunction with a release fluid, or fluororesin such as polytetrafluoroethylene (hereinafter referred to as "PTFE"), perfluoroalkylvinylether copolymer (hereinafter referred to as "PFA") and the like.

A heating member is typically provided for thermal fusing of electroscopic toner images. Several heating methods have been described for toner fusing in the prior art. In order to shorten the warm up time (the time required to heat the fuser or fixing member to the fusing temperature) an induction heating technique has been applied for toner fusing. An image fusing or fixing apparatus utilizing induction heating generally comprises a fusing member such as a roll or belt, an electromagnet component comprised of, for instance, a coil, which is electrically connected to a high-frequency power supplier. The coil is arranged at a position inside the fusing member or outside and near the fusing member. The fusing member suitable for induction heating comprises a metal heating layer. When a high-frequency alternating current provided by the power supplier is passed through the coil, an eddy current is induced within the heating metal of the fusing member to generate thermal energy by resistance to heat the fusing member to the desired temperature.

For example, U.S. Pat. Nos. 7,060,349 and 7,054,589, disclose an image fixing belt suitable for induction heating and a method of manufacturing the same, the entire disclosures of which are hereby incorporated by reference in their entireties.

SUMMARY

According to various embodiments, the present teachings include an induction heating member. The induction heating member can include a heating layer. The heating layer includes carbon nanotubes and metal.

The present teachings include a fuser member including a substrate and at least one heating layer disposed on the substrate. The heating layer includes an interpenetrating network of carbon nanotubes and silver. An outer layer is disposed on the heating layer and includes a fluoropolymer.

The present teachings further include an image rendering device which includes an image applying component for applying an image to a copy substrate and a fusing apparatus which receives the copy substrate with the applied image from the image applying component and fixes the applied image more permanently to the copy substrate. The fusing apparatus includes a fusing member and a pressure member which define a nip therebetween for receiving the copy substrate. The fuser member includes a substrate and a heating layer disposed on the substrate. The heating layer includes carbon nanotubes and metal. An outer layer is disposed on the heating layer and includes a fluoropolymer.

It is to be understood that both the foregoing general description and the following detailed description are exemplary and explanatory only and are not restrictive.

BRIEF DESCRIPTION OF THE DRAWINGS

The accompanying drawings, which are incorporated in and constitute a part of this specification, illustrate several embodiments and together with the description, serve to explain the principles of the disclosure.

DESCRIPTION OF THE EMBODIMENTS

Figure 1:
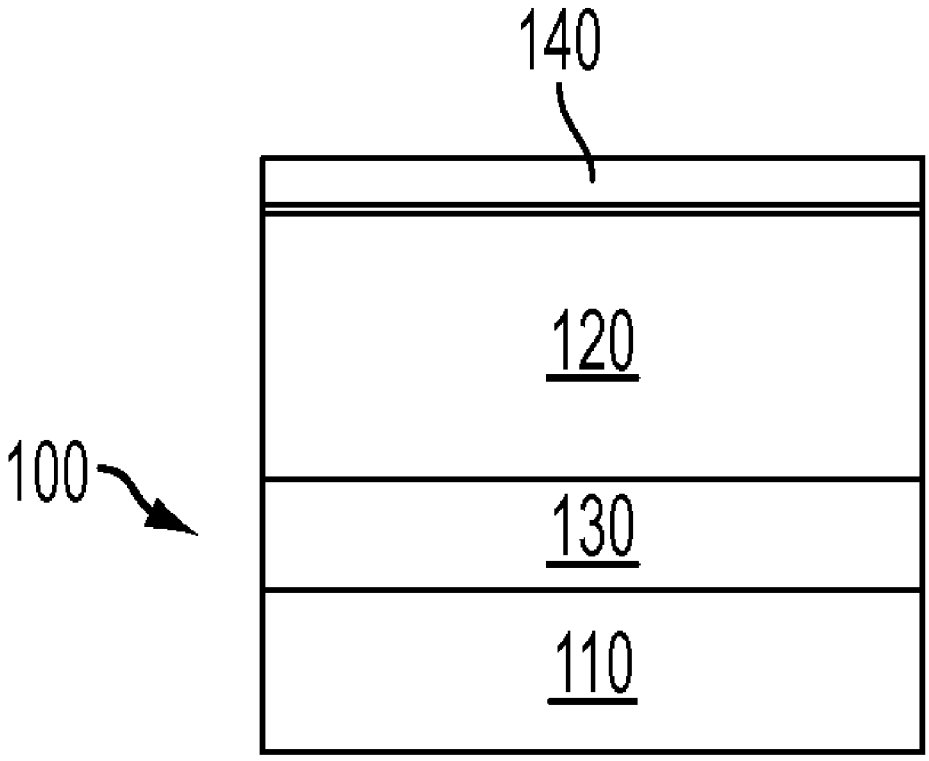
FIG. 1 depicts a portion of an exemplary fuser member in accordance with the present teachings.

Reference will now be made in detail to the drawing and descriptions. Wherever possible, the same reference numbers will be used throughout the drawings to refer to the same or like parts. In the following description, reference is made to the accompanying drawings that form a part thereof, and in which is shown aspects which may be practiced. The following description is exemplary.

While the following description has been illustrated with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description or the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of ranges stated as "less than 10" can assume values as defined earlier plus negative values, e.g. −1, −1.2, −1.89, −2, −2.5, −3, −10, −20, −30, etc.

In a typical electrophotographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, the photoreceptor is charged on its surface by means of an electrical charger to which a voltage has been supplied from a power supply. The photoreceptor is then imagewise exposed to light from an optical system or an image input apparatus, such as a laser and light emitting diode, to form an electrostatic latent image thereon. Generally, the electrostatic latent image is developed by bringing a developer mixture from developer station into contact therewith. Development can be effected by use of a magnetic brush, powder cloud, or other known development process.

After the toner particles have been deposited on the photoconductive surface in image configuration, they are transferred to a copy sheet by transfer means, which can be pressure transfer or electrostatic transfer. In embodiments, the developed image can be transferred to an intermediate transfer member and subsequently transferred to a copy sheet.

After the transfer of the developed image is complete, the copy sheet advances to a fusing station, where the developed image is fused to the copy sheet by passing the copy sheet between the fusing member and pressure member, thereby forming a permanent image. Fusing may be accomplished by the application of heat and pressure substantially concurrently by various means: a roll pair maintained in pressure contact; a belt member in pressure contact with a roll; and the like.

In an image fusing system with a fast warm up time, an image fusing or fixing apparatus generally includes a fusing member, such as a roll or belt, and an electromagnet component comprised of, for instance, a coil, which is electrically connected to a high-frequency power supplier. The coil is arranged at a position inside the fusing member or outside and near the fusing member. The fusing member suitable for induction heating includes a metal heating layer. When a high-frequency alternating current provided by the power supplier is passed through the coil, an eddy current is induced within the heating metal of the fusing member to generate thermal energy by resistance to heat the fusing member to the desired temperature. Image fusing members suitable for induction heating are known in the art, and may include a fuser belt with a multi-layer configuration comprised of, for example, a polyimide substrate, deposited on the substrate, a metal layer comprised of nickel or copper, an optional elastic layer comprised of an elastomer, and an outmost releasing layer. The fusing member may further include other layers between the substrate and the metal heating layer, the metal heating layer and the elastic layer, or the elastic layer and the releasing layer, for adhesion or other property improvements.

In one aspect there is provided a fuser member containing a heating layer and methods for forming the heating layer and the fuser member. The fuser member can include a substrate, a resilient layer, a surface layer and a heating layer disposed between the resilient layer and the surface layer. The resilient layer can include, for example, a silicone rubber layer and the surface layer can include, for example, a hydrophobic polymer with a surface free energy below 22 mN/m. The surface free energy is determined by the calculation using Lewis Acid-Base method from the results of the contact angle measured with Fibro DAT1100 instrument. Three liquids used were water, formamide, and diiodomethane. More specifically, the hydrophobic polymer includes, for example, a fluoropolymer such as a fluoroplastic of TEFLON materials such as polytetrafluoroethylene (PTFE), perfluoroalkoxy (PFA) and the like, and mixtures thereof. The heating layer can include a carbon-nanotube (CNT) and a metal containing layer, wherein the CNT is dispersed or contained therein.

Although the term "fuser member" is used herein for illustrative purposes, it is intended that the term "fuser member" also encompasses other members useful for an electrostatographic printing process including, but not limited to, a fixing member, a pressure member, a heat member and/or a donor member. The "fuser member" can be in a form of, for example, a belt, a plate, a sheet, a roll or the like.

FIG. 1 depicts a sectional view of an exemplary fuser member 100 in accordance with the present teachings. It should be readily apparent to one of ordinary skill in the art that the member 100 depicted in FIG. 1 represents a generalized schematic illustration and that other components/layers/films/particles can be added or existing components/layers/films/particles can be removed or modified.

As shown, the fuser member 100 can include a substrate 110, an intermediate or heating layer 130, a resilient layer 120, and a surface layer 140. The surface layer 140 can be formed over the resilient layer 120, which can in turn be formed over the substrate 110. The disclosed intermediate or heating layer 130 can be formed between the resilient layer 120 and the substrate 110 in order to provide desired properties, e.g., thermal stabilities, mechanical strength, etc., for forming and/or using the fuser member 100 at a temperature of about 250° C. or higher.

The substrate 110 can be in a form of, for example, a belt, plate, and/or cylindrical drum for the disclosed fuser member 100. The substrate of the fusing member is not limited, as long as it can provide high strength and physical properties that do not degrade at a fusing temperature. Specifically, the substrate can be made from a heat-resistant resin. Examples of the heat-resistant resin include resins having high heat resistance and high strength such as a polyimide, an aromatic polyimide, polyether imide, polyphthalamide, polyester, and a liquid crystal material such as a thermotropic liquid crystal polymer and the like. Particularly suitable is KAPTON® polyimide available from Dupont. The thickness of the substrate falls within a range where rigidity and flexibility enabling the fusing belt to be repeatedly turned can be compatibly established, for instance, ranging from about 10 to about 200 micrometers or from about 30 to about 100 micrometers.

The resilient layer 120 can include, for example, a rubber layer. The resilient layer provides elasticity and can include a silicone rubber as a main component and mixed with inorganic particles, for example SiC or $Al_2O_3$ as required.

Examples of suitable resilient layers include silicone rubbers such as room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning.

The surface layer 140, also referred to as a releasing layer, of the fusing member 100 is typically comprised of a fluorine-containing polymer to avoid toner stain. The thickness of such a releasing layer can range from about 3 micrometers to about 100 micrometers, or from about 5 micrometers to about 50 micrometers. Suitable fluorine-containing polymers may include fluoropolymers comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and cross-linked fluoroelastomers. Examples of fluoropolymer include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), a poly(tetrafluoroethylene), and mixtures therof.

Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the respective disclosures of which are incorporated by reference herein in their entirety. As described therein, these elastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and cure site monomer. These fluoroelastomers are known commercially under various designations such as VITON A® VITON B® VITON E® VITON E 60C®, VITON E430®, VITON 910®, VITON GH®; VITON GF®; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF® NM® FOR-THF® FOR-TFS® TH® NH® P757® TNS® T439® PL958® BR9151® and TN505®, available from Ausimont.

Examples of three known fluoroelastomers are (1) a class of copolymers of two of vinylidenefluoride, hexafluoropropylene, and tetrafluoroethylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, tetrafluoroethylene, and cure site monomer known commercially as VITON GH® or VITON GF®.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

Figure 2A:
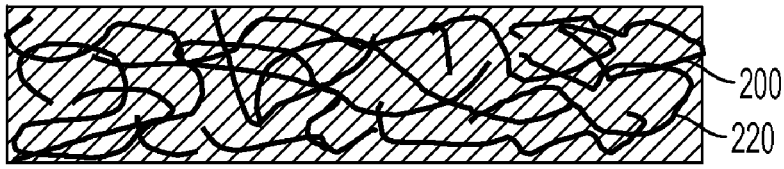
FIGS. 2(*a*)-2(*c*) are schematics showing exemplary heating layers used for the fuser member in FIG. 1 in accordance with the present teachings.
Figure 2B:
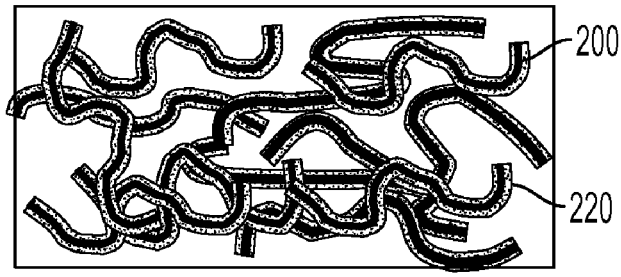
Figure 2C:
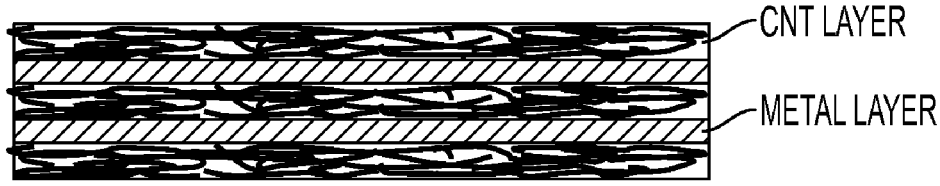

The heating layer 130 can be formed between the resilient layer 120 and the substrate 110. In various embodiments, the heating layer 130 can include a plurality of carbon nanotubes (CNTs) and metal. The carbon nanotubes can form an interpenetrating network within a metal layer as shown in FIG. 2(*a*). The carbon nanotubes 200 interpenetrate the metal 220 to form a strong, tough conductive layer. An alternate embodiment of layer 130, shown in FIG. 2(*b*), shows the carbon nanotube 200 coated with a layer of metal 220. These carbon nanotubes can be coated on the substrate within a polymer matrix. FIG. 2(*c*) shows another embodiment of layer 130, wherein layers of metal and carbon nanotubes coated with a layer of metal are stacked.

The metal is typically provided by metal nanoparticles, for example but not limited to, silver nanoparticles dispersed in a solvent, such as toluene, to be deposited on a polyimide substrate. The application may be by dip-coating, web-coating, or spraying the metal nanoparticle dispersion onto the substrate. Other metals that can be used for the metal layer include copper, nickel, and mixtures thereof.

As used herein and unless otherwise specified, the term "nanotubes" refers to elongated materials (including organic and inorganic materials) having at least one minor dimension, for example, width or diameter, of about 100 nanometers or less. Although the term "nanotubes" is used herein for illustrative purposes, it is intended that the term also encompasses other elongated structures of like dimensions including, but not limited to, nanoshafts, nanopillars, nanowires, nanorods, and nanoneedles and their various functionalized and derivatized fibril forms, which include nanofibers with exemplary forms of thread, yarn, fabrics, etc.

The nanotubes can also include single wall carbon nanotubes (SWCNTs), multi-wall carbon nanotubes (MWCNTs), and their various functionalized and derivatized fibril forms such as carbon nanofibers. In various embodiments, the nanotubes can have an inside diameter and an outside diameter. For example, the inside diameter can range from about 0.5 to about 20 nanometers, while the outside diameter can range from about 1 to about 80 nanometers. Alternatively, the nanotubes can have an aspect ratio, e.g., ranging from about 1 to about 1,000,000.

The nanotubes can have various cross sectional shapes, such as, for example, rectangular, polygonal, oval, elliptical, or circular shape. Accordingly, the nanotubes can have, for example, cylindrical three dimensional shapes.

The nanotubes can be formed of conductive or semi-conductive materials and can provide exceptional and desired functions, such as thermal (e.g., stability or conductivity), mechanical, and electrical (e.g., conductivity) functions. The loading of CNT ranges from 0.1 wt % to 90 wt %, preferably from 5% to 50% by weight.

Optionally, the metal coated carbon nanotubes can be dispersed in a polymer matrix. The polymer matrix can include one or more chemically or physically cross-linked polymers, such as, for example, thermoplastics, thermoelastomers, resins, polyperfluoroether elastomers, silicone elastomers, thermosetting polymers or other cross-linked materials. In various other embodiments, the polymers can include, for example, fluorinated polymers (i.e., fluoropolymers) including, but not limited to, fluoroelastomers (e.g. Viton), fluorinated thermoplastics including fluorinated polyethers, fluorinated polyimides, fluorinated polyetherketones, fluorinated polyamides, or fluorinated polyesters. In various embodiments, the one or more cross-linked polymers can be semi-soft and/or molten to mix with the metal coated carbon nanotubes.

The polymer matrix can include fluoroelastomers, e.g., having a monomeric repeat unit selected from the group consisting of tetrafluoroethylene, perfluoro(methyl vinyl ether), perfluoro(propyl vinyl ether), perfluoro(ethyl vinyl ether), vinylidene fluoride, hexafluoropropylene, and mixtures thereof. The polymer matrix can also include cured silicone elastomers.

Various embodiments can include methods for forming the fuser member 100 in accordance with the present teachings. During the formation, various layer-forming techniques, such as, for example, coating techniques, extrusion techniques and/or molding techniques, can be applied respectively to the substrate 110 to form the resilient layer 120, to the resilient layer 120 to form the intermediate layer 130, and/or to the heating layer 130 to form the surface layer 140.

As used herein, the term "coating technique" refers to a technique or a process for applying, forming, or depositing a dispersion to a material or a surface. Therefore, the term "coating" or "coating technique" is not particularly limited in the present teachings, and dip coating, painting, brush coating, roller coating, pad application, spray coating, spin coating, casting, or flow coating can be employed. For example, the composite dispersion for forming the heating layer 130 and a second dispersion for forming the surface layer 140 can be respectively coated on the resilient layer 120 and the formed heating layer 130 by spray-coating with an air-brush. In various embodiments, gap coating can be used to coat a flat substrate, such as a belt or plate, whereas flow coating can be used to coat a cylindrical substrate, such as a drum or fuser roll or fuser member substrate.

In various embodiments, the disclosed fuser member can include a heating layer having a thickness of about 0.1 micrometer to about 50 micrometers; a surface layer having a thickness of about 1 micrometer to about 40 micrometers; and a resilient layer having a thickness of about 2 micrometers to about 10 millimeters.

A surface layer (see 140 of FIG. 1) can be formed by applying a second dispersion to the resilient layer, followed by a thermal treatment. For example, following the curing process for forming the resilient layer, fluoroplastics dispersions prepared from PFA can be deposited onto the formed intermediate layer, for example, by spray- or powder-coating techniques. The surface layer deposition can then be baked at high temperatures of about 250° C. or higher, such as, for example, from about 350° C. to about 360° C.

In this manner, because the heating layer 130 can provide high temperature thermal stabilities and mechanical robustness, the high temperature baking or curing of the surface layer 140 can be performed to provide high quality surface layer to the fuser member 100, for example, without generating any defects within the underlying resilient layer 120 and the formed surface layer 140. In addition, due to the heating layer 130, the fuser member 100 can possess, for example, improved adhesion between layers, stability of depositions, improved thermal conductivities, and a long lifetime.

The metal-CNT composite layer 130 was fabricated by depositing metal and CNT on the polyimide substrate (FIG. 1, 110). The heating layer 130 can be prepared by spray-coating stable metal nanoparticle dispersions to form the metal layer, and then spray-coating the CNT aqueous dispersion to form the CNT layer, followed by thermal annealing the coated layers. The thickness of the composite layer is built up by repeating the coating and annealing process. The metal-CNT composite coatings (~15 micron thick) include Ag and multi-wall carbon nanotubes showed the same electrical conductivity of Ag (about 1.5 E+05 $S \cdot m^{-1}$) measured by four-probe measurement.

EXAMPLES

Synthesis of Oleic Acid-stabilized Nano-Ag:

Ag acetate (3.34 g, 20 mmol) and oleylamine (13.4 g, 50 mmol) were dissolved in 40 mL toluene and stirred at 55° C. for 5 minutes. Phenylhydrozine (1.19 g, 11 mmol) solution in toluene (10 mL) was added into Ag actetat-toulene solution drop-wise with vigorous stirring. The solution became dark red-brown color. The solution was stirred at 55° C. for 10 minutes. The solution prepared above was added drop-wise to a mixture of acetone/methanol (150 mL/150 mL). The precipitate was filtered and washed briefly with acetone and methanol. The gray solid obtained was dissolved in 50 mL of hexane, which was added drop-wise to a solution of oleic acid (14.12 g, 50 mmol) in hexane (50 mL) at room temperature. After 30 minutes, hexane was removed and the residue was poured into a stirring methanol (200 mL). After filtration, washing with methanol, and drying (in vacuo), a gray solid was obtained. Yield: 3.05 g (96%, based on Ag content of 68% from TGA analysis). 10% of Ag nanoparticles were dissolved in a solution of hexane/toluene (1:2) to form an Ag nanoparticle dispersion.

Preparation of CNT Aqueous Dispersion

Poly(acrylic acid) (0.05 g) was dissolved in 5 g of deionized water. 0.1 g of CNT was added into the solution. The dispersion was sonicated with a high power sonicator for 1 minutes (at 60% output) for several times until the uniform dispersion was achieved.

Coating on Polyimide Substrate:

The polyimide substrate was cleaned and etched by 5M KOH solution. The substrate was alternatively coated with a layer of CNT dispersion followed by baking at 200° C., then coated with a layer of nano-Ag dispersion and followed by baking at 250° C. to form the metal-CNT composite layer. The metal layer of nanoparticles (e.g. Ag nanoparticles) was deposited on the CNT-coated polyimide by spray-coating the Nano-Ag dispersion on the substrate.

The rest of silicone and PFA coatings can be coated using the current existing processes. The electrical conductivity of the above samples with Ag-CNT-Ag composite was measured by 4-probe measurement. The results are listed in the Table 1.

TABLE 1

Electrical Conductivity

| Sample # | Sample Description | Thickness | Electrical Conductivity ($S \cdot m^{-1}$) |
|---|---|---|---|
| 1 | PI-CNT(~5μ) | 5 | 1.37E+03 |
| 2 | PI-Ag (~2μ) | 2 | 2.57E+05 |
| 3 | PI-Ag-CNT-Ag-CNT-Ag (~15 μ) | 15 | 1.52E+05 |

Figure 3:
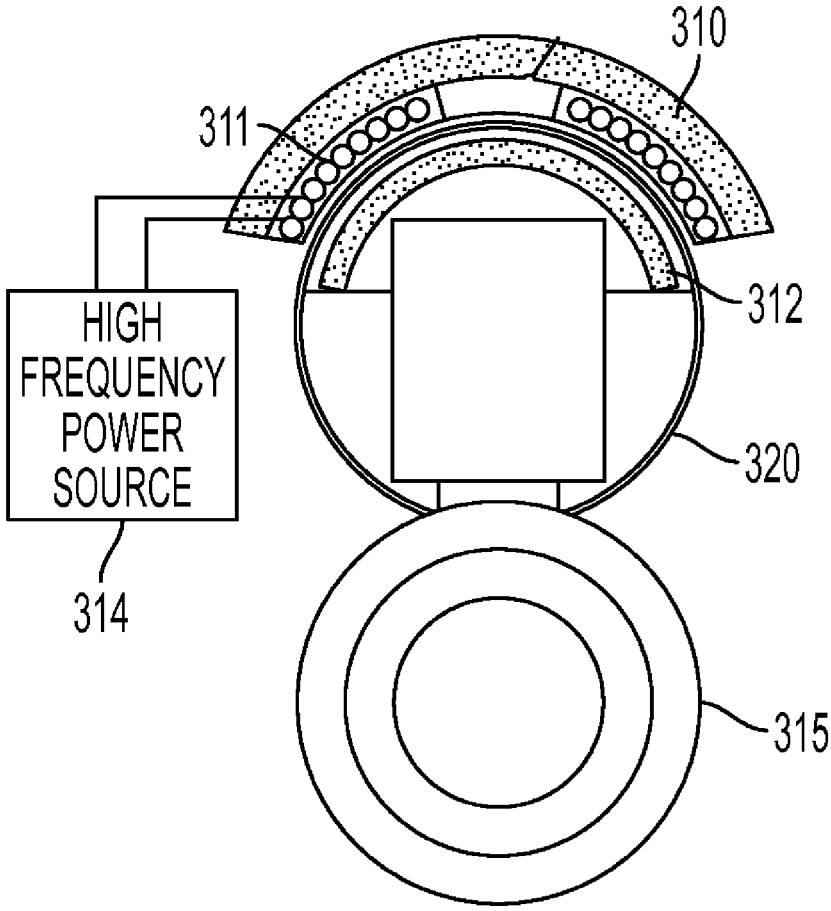
FIG. 3 depicts an exemplary method for forming the fuser member of FIG. 1 in accordance with the present teachings.

Based on the electrical conductivity and thickness of the composite material an induction heating (IH) model was run to determine the amount of induced heating in a belt with the composite Ag-CNT material as the heating layer. FIG. 3 shows a schematic of the inductively heated Ag-CNT belt fuser. Outer ferrite sleeve 310 and inner ferrite sleeve 312 are used to enhance the eddy current heating in the fuser member 320 containing the Ag-CNT heating layer. Induction coil 311 is connected to high frequency power source 314. When a high frequency alternating current is passed through the coil, an eddy current is induced in the heating layer of fusing member 320 which generates thermal energy and heats the fuser member. Pressure roll 315 is shown in FIG. 3 to ensure contact of the substrate (not shown) with the fuser member 320.

Figure 4:
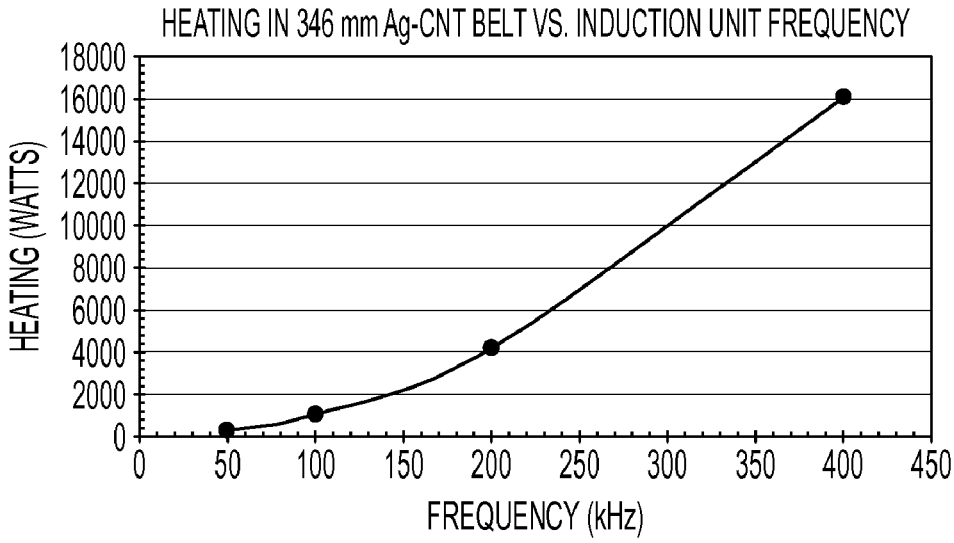
FIG. 4 shows the heating induced in a 346 mm wide belt as a function of induction unit frequency for an embodiment of the fuser member.

FIG. 4 shows the amount of heating in a 346 mm wide belt as a function of induction unit frequency. At 100 kHz the induced heating is 1 kW.

Figure 5:
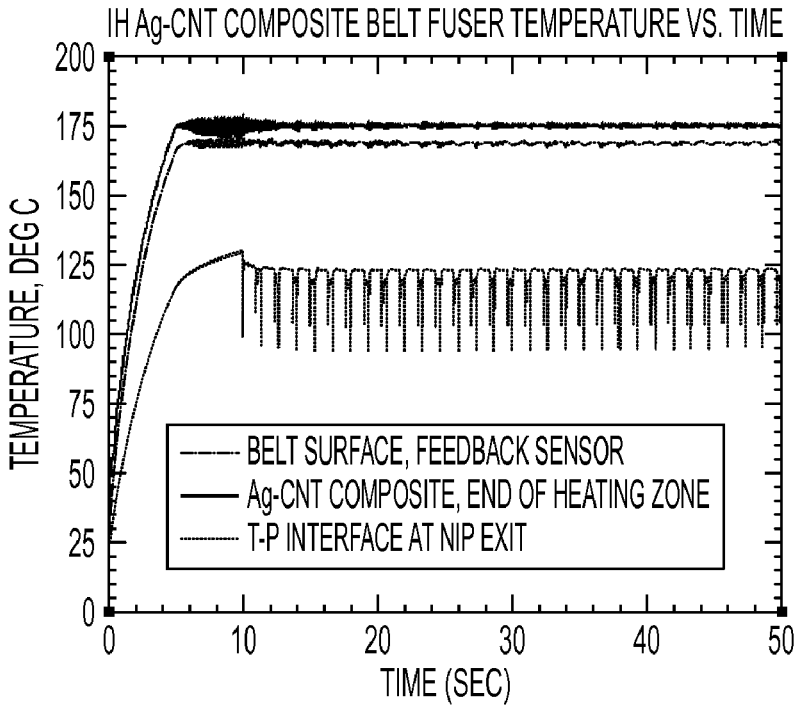
FIG. 5 shows the time to reach operating temperature at 100 kHz in a 346 mm wide belt in an embodiment of the fuser member.

A thermal simulation of the Ag-CNT belt shows that with the heating induced when IH unit is operating at 100 kHz, the fuser will warm-up in about 5 sec and good fusing is achieved as the Toner paper interface temperature at the exit of the fusing nip is 124° C. This is demonstrated in FIG. 5. The advantages of the embodiments described herein include a higher efficiency of the induction heating member along with a lower cost and density.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, and are also intended to be encompassed by the following claims.

What is claimed is:

1. A fuser member comprising:

a substrate;

a heat induction layer disposed on the substrate, the heat induction layer comprising carbon nanotubes coated with a layer of metal dispersed in a polymer matrix; and an outer layer comprising a fluoropolymer disposed on the heat inductive layer.

2. The fuser member of claim 1 wherein the carbon nanotubes comprise a single wall carbon nanotube (SWCNT) or a multi-wall carbon nanotube (MWCNT).

3. The fuser member of claim 1 wherein the carbon nanotubes comprise from about 0.1 percent to about 50 percent by weight of the heat induction layer.

4. The fuser member of claim 1 wherein the metal is selected from the group consisting of nickel, copper, iron and silver.

5. The fuser member of claim 1 wherein the polymer matrix comprises a material selected from the group consisting of thermoplastics, thermoelastomers, resins, polyperfluoroether elastomers, silicone elastomers and thermosetting polymers.

6. The fuser member of claim 1 wherein the polymer matrix comprises a polymer selected from fluorinated polymers and fluorinated thermoplastics.

7. The fuser member of claim 1 wherein the polymer matrix comprises a polymer selected from the group consisting of fluoroelastomers and cured silicone elastomers.

8. A fuser member, for fixing a developed image, comprising:

a substrate;

a heat induction layer disposed on the substrate, the heat induction layer comprising carbon nanotubes coated with a layer of metal dispersed in a polymer matrix; and an outer layer comprising a hydrophobic polymer with a surface free energy below 22 mN/m.

9. The fuser member of claim 8 wherein the substrate is selected from the group consisting of a polyimide, a polyetherimide, a poly(amide-imide), a polyamide, a polyether, a polyester and a liquid crystal material.

10. The fuser member of claim 8 wherein the carbon nanotubes comprise a single wall carbon nanotube (SWCNT) or a multi-wall carbon nanotube (MWCNT).

11. The fuser member of claim 8, wherein the carbon nanotubes comprise from about 0.1 percent to about 50 percent by weight of the heat induction layer.

12. The fuser member of claim 8 wherein the metal is selected from the group consisting of nickel, copper and silver.

13. The fuser member of claim 8 wherein the hydrophobic polymer is a fluoropolymer selected from the group consisting of polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VDF), and hexafluoropropylene (HFP).

14. The fuser member of claim 8, wherein the substrate is in a form of a cylinder, a belt or a sheet.

15. The fuser member of claim 8 further comprising a silicone rubber resilient layer disposed between the heating layer and the outer layer.

16. The fuser member of claim 8 wherein the polymer matrix comprises a material selected from the group consisting of thermoplastics, thermoelastomers, resins, polyperfluoroether elastomers, silicone elastomers and thermosetting polymers.

17. The fuser member of claim 8 wherein the polymer matrix comprises a polymer selected from fluorinated polymers and fluorinated thermoplastics.

18. The fuser member of claim 8 wherein the polymer matrix comprises a polymer selected from the group consisting of fluoroelastomers and cured silicone elastomers.

19. The fuser member of claim 8 wherein the heat induction layer comprises a thickness of about 0.1 micrometer to about 50 micrometers.

20. An image rendering device comprising: an image applying component for applying an image to a copy substrate; and a fusing apparatus which receives the copy substrate with the applied image from the image applying component and fixes the applied image more permanently to the copy substrate, the fusing apparatus comprising a fusing member and a pressure member which define a nip therebetween for receiving the copy substrate therethrough, the fuser member comprising; a substrate; a heat induction layer disposed on the substrate, the heat induction layer comprising carbon nanotubes coated with a layer of metal dispersed in a polymer matrix; and an outer layer comprising a fluoropolymer disposed on the heating layer.

* * * * *